US010312047B1

(12) United States Patent
Smith

(10) Patent No.: US 10,312,047 B1
(45) Date of Patent: Jun. 4, 2019

(54) PASSIVE LOCAL AREA SATURATION OF ELECTRON BOMBARDED GAIN

(71) Applicant: Eagle Technology, LLC, Melbourne, FL (US)

(72) Inventor: Arlynn W. Smith, Blue Ridge, VA (US)

(73) Assignee: Eagle Technology, LLC, Melbourne, FL (US)

( * ) Notice: Subject to any disclaimer, the term of this patent is extended or adjusted under 35 U.S.C. 154(b) by 0 days.

(21) Appl. No.: 15/995,952

(22) Filed: Jun. 1, 2018

(51) Int. Cl.
*H01J 29/89* (2006.01)
*H01J 31/50* (2006.01)

(52) U.S. Cl.
CPC ..... *H01J 29/89* (2013.01); *H01J 31/505* (2013.01)

(58) Field of Classification Search
CPC ..... H01J 29/89; H01J 29/4966; H01J 29/513; H01J 29/517; H01J 29/518; H01J 31/505
See application file for complete search history.

(56) References Cited

U.S. PATENT DOCUMENTS

| | | | | |
|---|---|---|---|---|
| 6,298,178 | B1 | 10/2001 | Day et al. | |
| 6,836,059 | B2 | 12/2004 | Smith | |
| 10,153,039 | B1 * | 12/2018 | Bhattacharyya .... | G11C 11/5671 |
| 2018/0204977 | A1 * | 7/2018 | Dheeraj ..... | H01L 31/035227 |
| 2019/0006558 | A1 * | 1/2019 | Watanabe ..... | H01L 33/06 |

OTHER PUBLICATIONS

MacDonald, D., and A. Chevas, "The Use of Injection-Level Dependent Lifetime Measurements for Determining Solar Cell Parameters," Proc. 38th Annu. Australian New Zealand Sol. Energy Conf., pp. 494-500 (2000).

Pang, S.K., et al., "Effect of Trap Location and Trap-assisted Auger Recombination on Silicon Solar Cell Performance," IEEE Transactions on Electron Devices, vol. 42(4):662-668 (Apr. 1995).

Park, S., et al., "Influence of Carrier Lifetime on Performance of Silicon p-i-n Variable Optical Attenuators Fabricated on Submicrometer Rib Waveguides," Optics Express, vol. 18(11):1182-11291 (2010).

* cited by examiner

*Primary Examiner* — Anne M Hines
(74) *Attorney, Agent, or Firm* — Edell, Shapiro & Finnan, LLC

(57) ABSTRACT

Methods and systems to intensify an image, such as in a night vision apparatus, include a semi-conductor structure that includes a first region that is doped to generate a plurality of electrons and corresponding holes for each electron that impinges a reception surface of the semi-conductor structure, a second region that is doped to attract the holes, an electrically conductive region to output the holes from the second region, and a third region that is doped to restrict a flow of the holes from the second region to the electrically conductive region such that some of the holes will combine with some of the plurality of electrons within the first region. The first region further includes an emission area from which to emit remaining ones of the plurality of electrons.

16 Claims, 7 Drawing Sheets

VIEW A

VIEW A

VIEW A

VIEW A

PASSIVE LOCAL AREA SATURATION OF ELECTRON BOMBARDED GAIN

BACKGROUND

Image intensifiers are used in low light (e.g., night vision) applications to amplify ambient light into a more visible image.

When viewing scenes through an image intensifier, localized areas of high light intensity lead to excessive numbers of electrons in those areas, which negatively impacts image fidelity. Thus, localized areas of high light intensity need to be selectively gained down to optimize scene reproduction. This may be referred to herein as "braking."

In micro-channel plate (MPC) based intensifiers, braking is provided by the strip current of the plate. Currently, for electron bombarded gain there is no "braking" mechanism to locally limit the number of electron-hole pairs (EHPs) created by a bright spot in an otherwise dark background. Techniques to control this issue in conventional proximity-focused intensifiers are not applicable to semiconductor based electron multipliers.

SUMMARY

Methods and systems to intensify an image, such as in a night vision apparatus, include a semi-conductor structure that includes a first region that is doped to generate a plurality of electrons and corresponding electron holes for each electron that impinges a reception surface of the semi-conductor structure, a second region that is doped to attract the electron hole pairs, an electrically conductive terminal to output the electron hole pairs from the second region, and a third region that is doped to restrict a flow of the holes from the second region to the electrically conductive terminal such that some of the holes will combine with some of the plurality of electrons within the first region. The first region further includes an emission area from which to emit remaining ones of the plurality of electrons.

DETAILED DESCRIPTION

Disclosed herein are techniques to restrict the outflow of holes from a semiconductor electron multiplier to mitigate the number of electrons in high light intensity areas.

Figure 1:
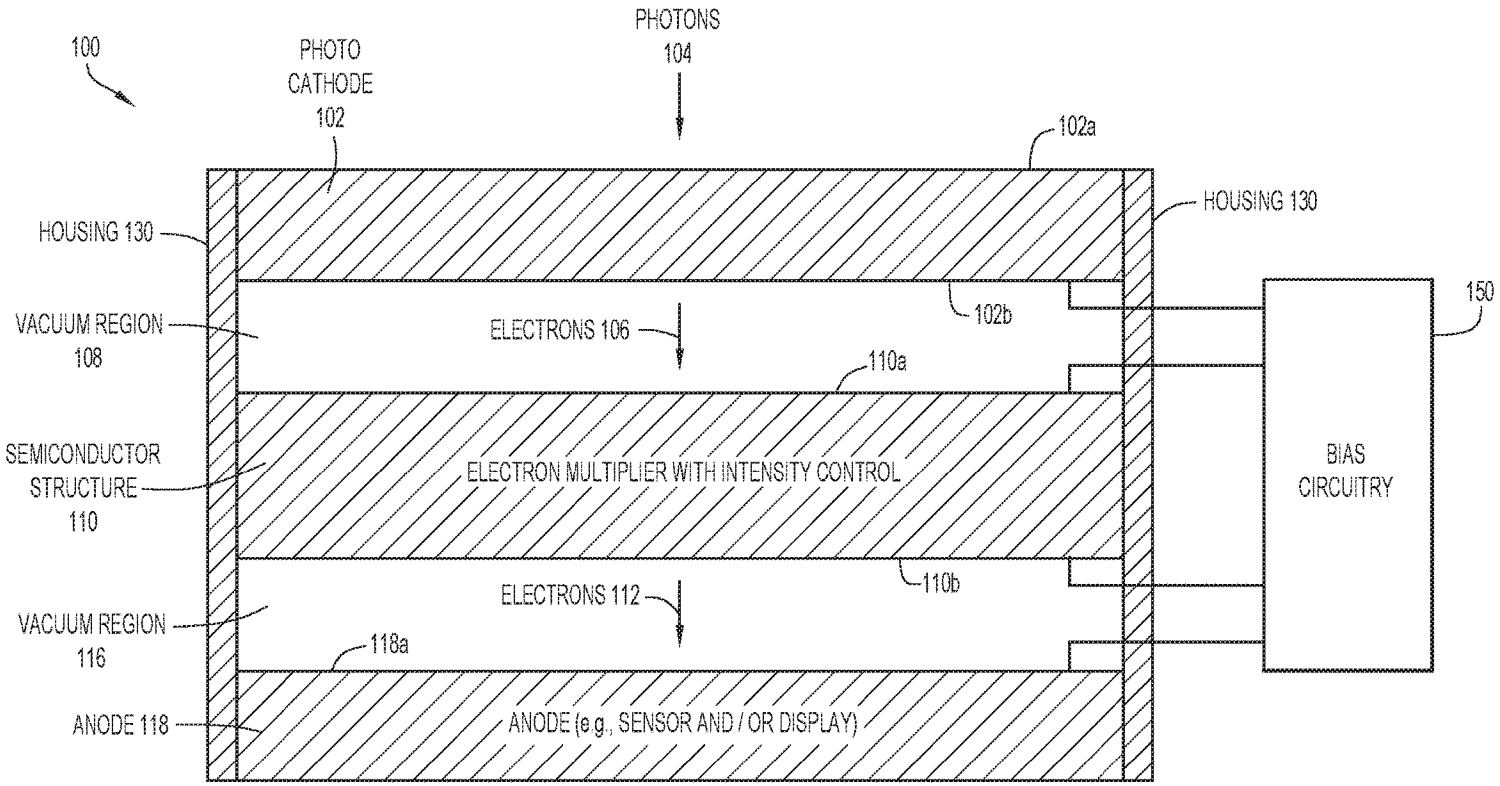
FIG. 1 is a cross-sectional view of an image-intensifier that includes a semiconductor structure configured as an electron multiplier with intensity control.

FIG. 1 is a cross-sectional view of an image-intensifier 100. Image-intensifier 100 may be configured as a night vision apparatus. Image-intensifier 100 is not, however, limited to a night vision apparatus.

Image intensifier 100 includes a photo-cathode 102 to convert photons 104 to electrons 106. Each photon 104 that impinges an input surface 102*a* has a probability to create a free electron 106. Free electrons 106 are emitted from an output surface 102*b*. Output surface 102*b* may be activated to a negative electron affinity state to facilitate the flow of electrons 106 from output surface 102*b*.

Photo-cathode 102 may be fabricated from a semiconductor material that exhibits a photo emissive effect, such as gallium arsenide (GaAs), GaP, GaInAsP, InAsP, InGaAs, and/or other semiconductor material. Alternatively, photo-cathode 102 may be a known Bi-alkali.

In an embodiment, a photo-emissive semiconductor material of photo-cathode 102 absorbs photons, which increases a carrier density of the semiconductor material, which causes the semiconductor material to generate a photo-current of electrons 106, which are emitted from output surface 102*b*.

Image intensifier 100 further includes a semiconductor structure 110 configured as an electron multiplier with intensity control, to generate a plurality of electrons 112 for each electron 106 that impinges an input surface 110*a* of semi-conductor structure 110, and to control an intensity of electrons 112.

Semiconductor structure 110 may also be referred to herein as an electron multiplier, an electron amplifier, and/or an electron bombarded device (EBD). Semiconductor structure 110 may be configured to generate, for example and without limitation, several hundred electrons 112 for each electron 106 that impinges surface 110*a*.

Image intensifier 100 further includes an anode 118 to receive electrons 112 from semiconductor structure 110. Anode 118 may include a sensor to sense electrons 112 that impinge a surface 118*a* of anode 118. Anode 118 may include a phosphor screen to convert electrons 112 to photons. Anode 118 may include an integrated circuit having a CMOS substrate and a plurality of collection wells. In this example, electrons collected in the collection wells may be processed with a signal processor to produce an image, which may be provided to an image display device.

Image intensifier 100 further includes a vacuum region 108 to facilitate electrons flow between photo cathode 102 and semiconductor structure 110.

Image intensifier 100 further includes a vacuum region 116 to facilitate electron flow between semiconductor structure 110 and anode 118.

Image intensifier 100 and/or portions thereof, may be configured as described in one or more examples below. Image intensifier 100 is not, however, limited to the examples below.

Image intensifier 100 further includes a bias circuit 150. In the example of FIG. 1, bias circuit 150 is configured to apply a first bias voltage between photo-cathode 106 and semiconductor structure 110, a second bias voltage between input surface 110*a* and an output surface 110*b* of semiconductor structure 110, and a third bias voltage between semiconductor structure 110 and anode 118 (e.g., to draw electrons 112 through semiconductor structure 110 towards a surface 118*a* of anode 118.

A peripheral surface of photo-cathode 102 may be coated with a conductive material, such as chrome, to provide an electrical contact to photo-cathode 102.

A peripheral surface of semiconductor structure 110 may be coated with a conducting material, such as chrome, to provide an electrical contact to one or more surfaces of semiconductor structure 110.

A peripheral surface of anode 118 may be coated with a conductive material, such as chrome, to provide an electrical contact to anode 118.

Image intensifier 100 may include a vacuum housing 130 to house photo-cathode 102, semiconductor structure 110, and anode 118.

Photo-cathode 102 and semiconductor structure 110 may be positioned such that output surface 102*b* of photo-cathode 102 is in relatively close proximity to input surface 110*a* of semiconductor structure 110 (e.g., less than approximately 10 micrometers or microns).

Semiconductor structure 110 and anode 118 may be positioned such that emission surface 110*b* is in relatively close proximity to anode surface 118*a*. For example, if anode 118 includes an integrated circuit, the distance between emission surface 110*b* and anode surface 118*a* may be, without limitation, approximately 5 millimeters. If anode 118*a* includes a phosphor screen, the distance between emission surface 110*b* and sensor surface 118*a* may be, without limitation, approximately 10 milometers.

Image intensifier 100, or portions thereof, may be configured as described in one or more examples below. Image intensifier 100 is not, however, limited to the examples below.

Figure 2:
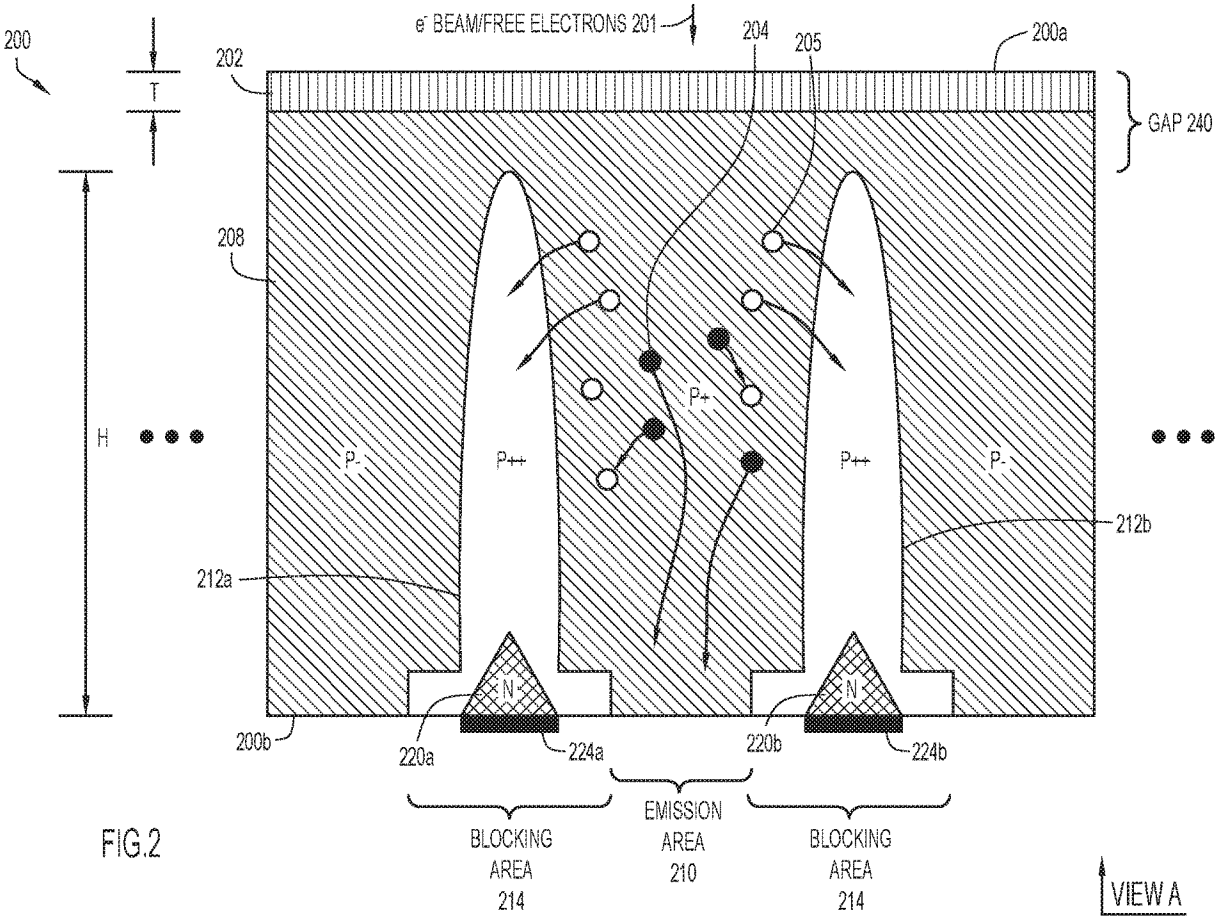
FIG. 2 is cross-sectional view of another semiconductor structure configured as an electron multiplier with intensity control, which may represent an example embodiment of the semiconductor structure of FIG. 1.

FIG. 2 is cross-sectional view of a semiconductor structure 200, configured as an electron multiplier with intensity control. Semiconductor structure 200 may represent an example embodiment of semiconductor structure 110 in FIG. 1.

Semiconductor structure 200 is doped to generate a plurality of electron-hole pairs for each electron 201 that impinges a surface 200*a* of semiconductor structure 200. In FIG. 2, the plurality of electron-hole pairs include free electrons 204 (dark circles), and holes 205 (light circles).

Semiconductor structure 200 includes first and second regions 202 and 208, which are doped to direct the flow of electrons 204 (i.e., free electrons) to emission areas 210 of emission surface 202*b*. Emission areas 210 may be activated to a negative electron affinity state to facilitate electron flow from emission regions 210.

First region 202 is doped to force free electrons 204 away from input surface 200*a* into semiconductor structure 200, thus inhibiting recombination of free electrons 204 with holes 205 at input surface 200*a*. Inhibiting recombination of electron-hole pairs at input surface 200*a* ensures that more electrons flow through semiconductor structure 200 to emission surface 200*b*, thereby increasing efficiency.

Region 208 (alone and/or in combination with region 202), may also be referred to herein as an electron multiplier region.

Semiconductor structure 200 further includes regions 212, which are doped to attract holes 205, and to repel free electrons 204. Regions 212 may also be referred to herein as blocking structures 212. Blocking structures 212 define blocking areas 214 of emission surface 200*b*, where electron flow into and out of semiconductor structure 200 is inhibited. Blocking regions 212 may help to maintain spatial fidelity. Blocking structures 212 may provide other benefits and/or perform other functions.

Semiconductor structure 200 may provide suitable electron multiplication without blocking structures 212. Thus, in an embodiment, blocking structures 212 are omitted.

Semiconductor structure 200 further includes electrically conductive contacts or terminals 224 positioned over blocking areas 214 of emission surface 200*b*, to draw holes from blocking structures 212 (e.g., to an external circuit).

In FIG. 1, when a high intensity beam of photons 104 strikes or contacts a relatively small area of surface 200*a*, a corresponding area of anode 118 may be saturated, which may make it difficult for a viewer to see other (i.e., less-bright) images of other objects that are proximate to the saturated area.

In FIG. 2, semiconductor structure 200 further includes restrictor regions 220 that are doped to restrict or govern intensity.

An example embodiment is provided below in which semiconductor structure 200 includes silicon. Semiconductor structure 200 is not, however, limited to silicon. Semiconductor structure 200 may include other semi conductive material such as, without limitation, gallium arsenide (GaAs). Free electrons tend to be attracted to N-type material. Holes tend to be attracted to P-type material.

In the example embodiment below, semiconductor structure 200 includes silicon and is relatively moderately doped with a P-type dopant (illustrated as P−), to generate a plurality of free electrons 204 for each free electron 201 that impinges a surface 200*a* of semiconductor structure 200. First doped region 202 may be doped with a p-type dopant such as boron or aluminum. First doped region 202 may be relatively heavily doped (e.g., $10^{17}$ parts per cubic centimeter). Blocking structures 212 may be relatively moderately doped with a P-type dopant such as boron or aluminum (e.g., $10^{18}$ or $10^{19}$ parts per cubic centimeter). Restrictor regions 220 are doped with an N-type material.

Holes 205 tend to diffuse to more heavily doped P-regions, such as from region 208 to blocking regions 212. From blocking regions 212, holes 205 may be drawn out through terminals 224. Free electrons 204, on the other hand, are repelled from regions of P-type doping (e.g., towards regions of N-type doping). A rate which holes 204 can be drawn from terminals 224 is determined by a doping density and area of the N/P junctions (leakage current density) between blocking structures 212 and respective restrictor regions 220.

When electrons-hole pairs 204/205 are generated at a relatively high rate (i.e., localized intensity), the flow of holes 205 to terminal 224 is restricted or throttled by restrictor structure 220. When the flow of holes to terminal 224*a* and/or 224*b* is restricted by restrictor regions 220, a portion of region 208 between blocking structures 212*a* and 212*b* becomes saturated with holes 204, which leads to re-combination of some of holes 205 with some of free electrons 204. Remaining free electrons 204 may reach emission area 210. Restrictor regions 220 thus indirectly restrict the number of free electrons 204 that reach emission area 210.

Also when the portion of region 208 becomes saturated with holes 205, the normally lightly P-doped (i.e., P−) portion of region 208, between blocking structures 212*a* and 212*b*, changes from relatively lightly doped (i.e., P−) to more moderately doped (i.e., P+). When the saturation subsides, the portion of region 208 between blocking structures 212*a* and 212*b* returns to relatively lightly P-doped (i.e., P−).

The N/P region between N-doped restrictor regions 220 and P-doped region 208 may function similar or analogous to a diode-like arrangement. The only current that flows is a reverse bias junction current of the N/P diode. The amount of current per unit density may be controlled, adjusted, and or determined by the doping density of the N and P type regions, and the area between restriction region 220 and terminal 224.

The N-type doping density of restrictor region 220 may be selected based on a target doping intensity of blocking structures 212 (i.e., p++), such that the portion of region 208 between blocking structures 212 begins to saturate with holes when a rate of production of electron/hole pairs 204 and 205 exceeds a rate at which holes 205 can be drawn from terminal 224.

An area of terminal 224 (and a corresponding surface area of restrictor region 224, may be relatively small compared to blocking area 214.

Semiconductor structure 200 may have a thickness of, without limitation, approximately 20-30 microns). First doped region 202 may have a thickness T of approximately 100-300 nanometers. Blocking structures 212 may have a height H of approximately 24 microns.

A gap 240 may be provided between first doped region 202 and blocking structures 212. Gap 240 may be sized or dimensioned such that second doped region 212 does not interfere with the generation of electrons 204 at input surface 200*a*. This may provide semiconductor structure 200 with an effective electron multiplication area that equals or approaches 100% of an area of input surface 200*a*. Gap 240 may be, without limitation, approximately one micron.

Other suitable dopants, concentrations, dimensions, and/or semiconductor materials, such as GaAs, may be used, as will be readily apparent to one skilled in the relevant art(s).

In FIG. 2, regions between adjacent blocking structures 212 may be viewed as channels that extend from input surface 200*a* to emission areas 210. The channels have relatively wide cross-sectional areas near input surface 200*a*, and relatively narrow cross-sectional areas towards emission areas 210. The channels may act as funnels to direct electrons 204 to emission areas 210. The channels may also be referred to herein as an electron bombarded cells (EBCs). Semiconductor structure 200 may be configured with an array of EBCs, such as described below with reference to FIGS. 3 through 6. Semiconductor structure 200 is not, however, limited to the examples of any of FIGS. 3 through 6.

Figure 3:
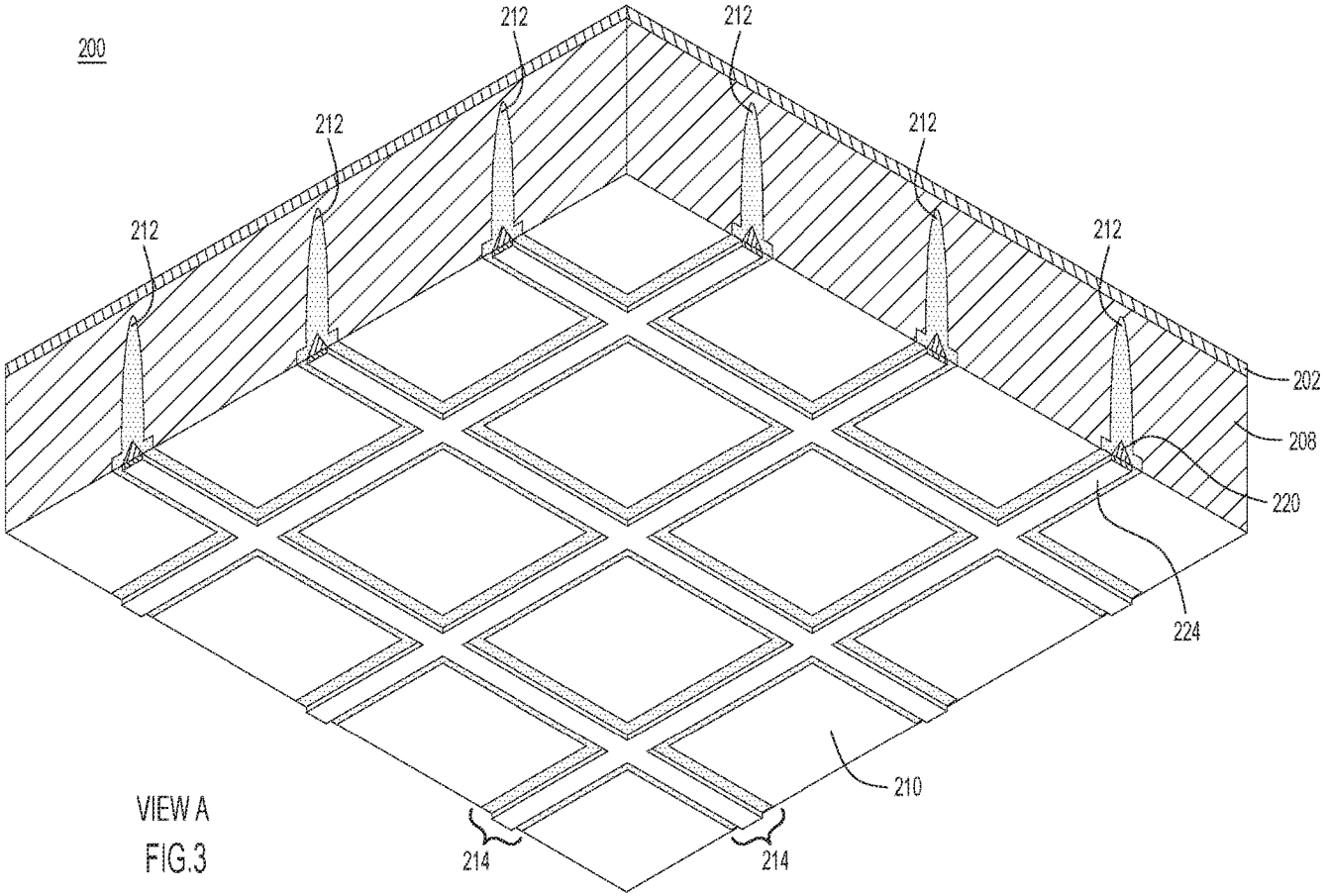
FIG. 3 is 3-dimensional cross-sectional perspective view of an example embodiment of the semiconductor structure of FIG. 2, in which the semiconductor structure includes multiple rows of parallel and perpendicular blocking structures to form an array of emission areas.

FIG. 3 is 3-dimensional cross-sectional perspective view of an example embodiment of semiconductor structure 200 directed toward emission surface 200*b* (View A in FIG. 2), in which semiconductor structure 200 includes multiple rows of parallel and perpendicular blocking structures 212, to form an array of emission areas 210.

Figure 4:
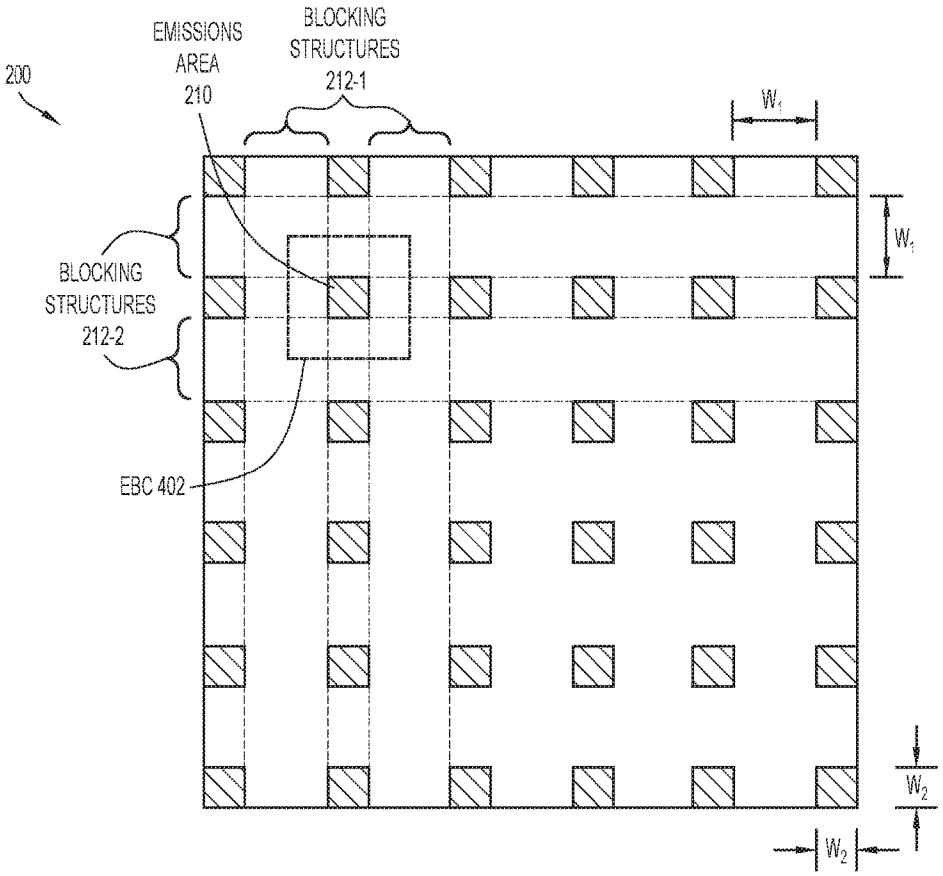
FIG. 4 is 2-dimensional view an example embodiment of the semiconductor structure of FIG. 2 in which electrically conductive terminals are omitted for illustrative purposes.

FIG. 4 is 2-dimensional view an example embodiment of semiconductor structure 200 directed toward emission surface 200*b* (View A in FIG. 3), in which restrictor regions 220 and terminals 124 are omitted for illustrative purposes. In this embodiment, semiconductor structure 200 includes a first set of multiple rows of blocking structures 212-1, and a second set of multiple rows of blocking structures 212-2. Blocking structures 212-1 are perpendicular to blocking structures 212-2, to define emission areas 210, and EBCs 402.

Semiconductor structure 200 may be configured to generate, for example, several hundred electrons in each EBC 402 that receives an electron. The number of electrons emitted from emission areas 210 may thus be significantly greater than the number of electrons that impinge input surface 200*a*.

Figure 5:
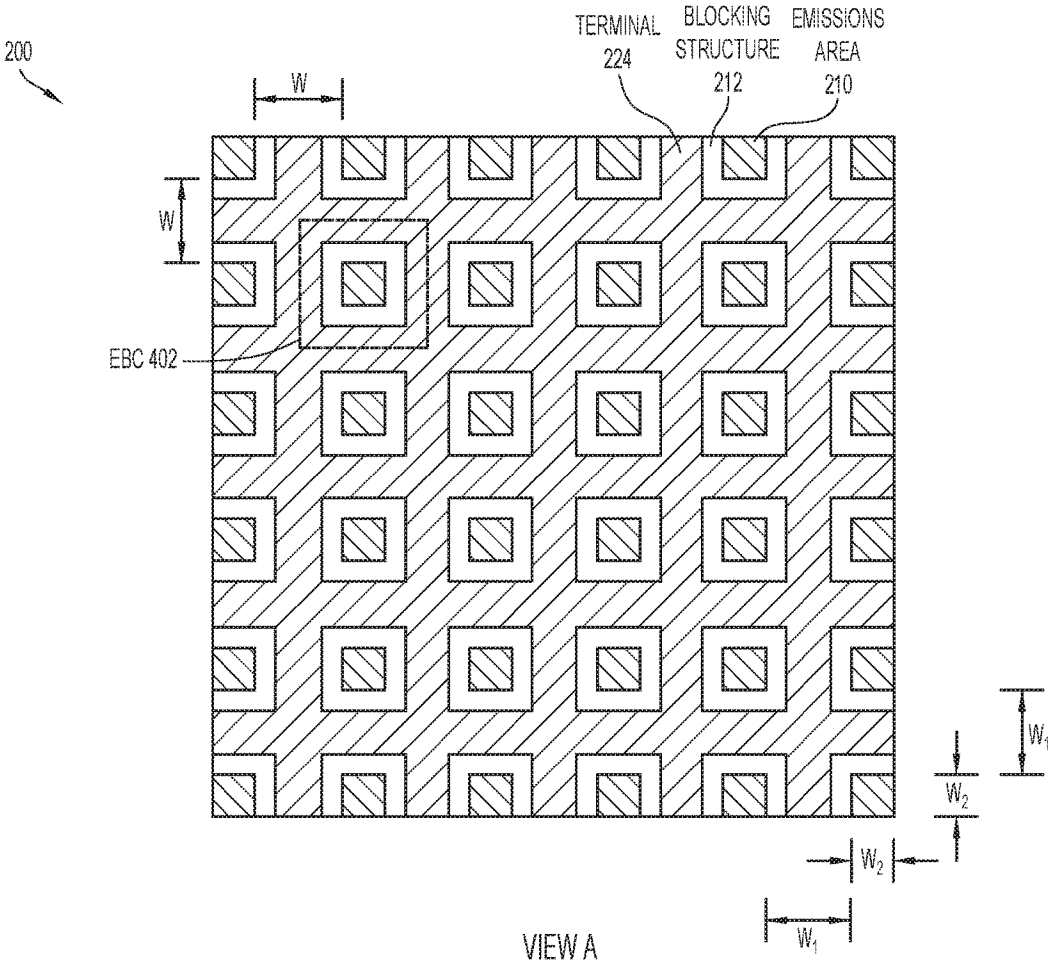
FIG. 5 is another view of the example embodiment of FIG. 4, in which electrically conductive terminals are illustrated.

FIG. 5 is another view of the example embodiment of FIG. 4, in which terminals 124 are illustrated. In an embodiment, a width $W_1$ of a base portion of blocking structures 212 is approximately 10-20 microns, and a width $W_2$ of emission areas 210 is approximately 0.5 to 2.0 microns. In this example, blocking areas 210 encompass more than 80% of an area of emission surface 200*b* of semiconductor structure 200. Semiconductor structure 200 is not, however, limited to these examples.

Figure 6:
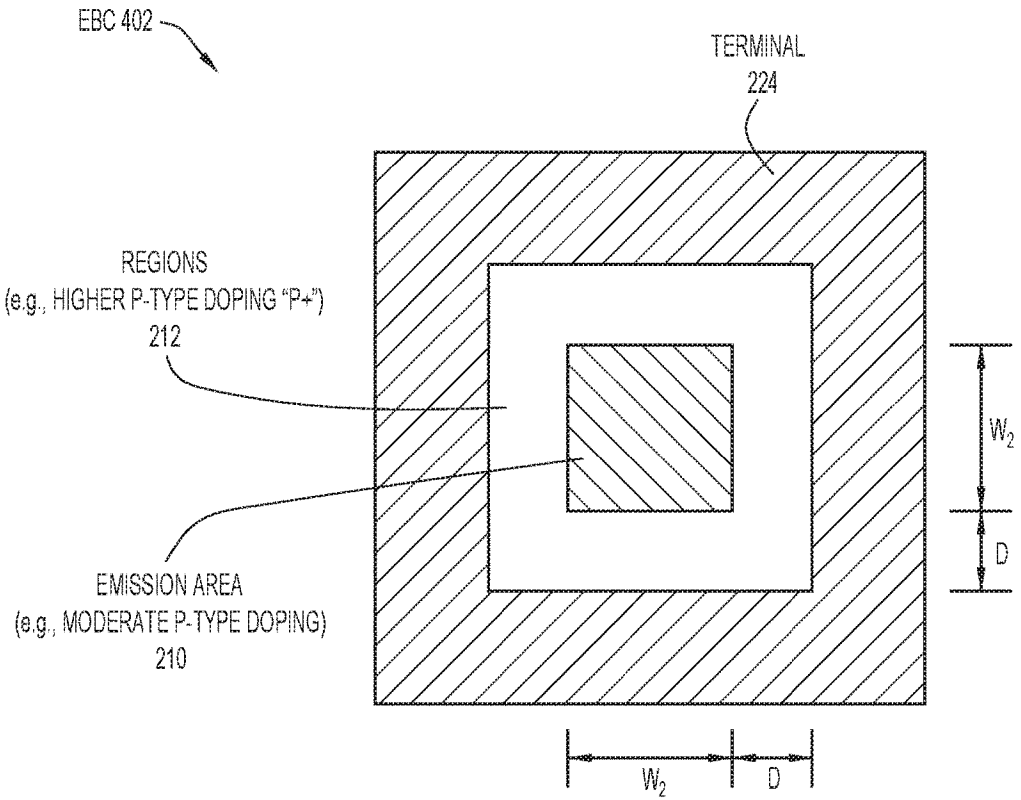
FIG. 6 depicts an expanded view of an electron bombarded cell of an electron multiplier of FIG. 4.

FIG. 6 depicts an expanded view of an EBC 402. In an embodiment, emission area 210 has a width W2 of is approximately 1 micron. An exposed portion (e.g., ring) of blocking structure 212 extends a distance D of approximately 0.5 micron beyond emission area 210.

In the examples of FIGS. 3, 4, and 5, semiconductor structure 200 is illustrated as a square array of EBCs 402. Semiconductor structure 200 may be configured with other geometric (e.g., circular, rectangular, or other polygonal shape), which may depend upon an application (e.g., circular for lens compatibility, or square/rectangular for integrated circuit compatibility). In an embodiment, to replicate a conventional micro-channel plate used in an image intensifier tube, a square array 1000×3000 EBCs 402, or more, may be used. This may be useful, for example, to replicate a micro-channel plate of a conventional image intensifier tube.

In the examples of FIGS. 4 and 5, semiconductor structure 200 is depicted as a 6×6 array of EBCs 402. Semiconductor structure 200 is not, however, limited to this example. The number of EBCs 402 employed in an array may be more or less than in the foregoing example, and may depend on the size of the individual EBCs 402 and/or a desired resolution of an image intensifier.

In the examples of FIGS. 3 through 6, emission areas 210 are depicted as having square shapes. Emission areas 210 are not, however, limited to square shapes. Emission areas 210 may, for example, be configured as circles and/or other geometric shape(s).

Each EBC 402 and associated emission area 210 corresponds to a region of input surface 200*a* (FIG. 2), such that the array of EBCs 402 pixelate electrons received at input surface 200*a*.

Figure 7:
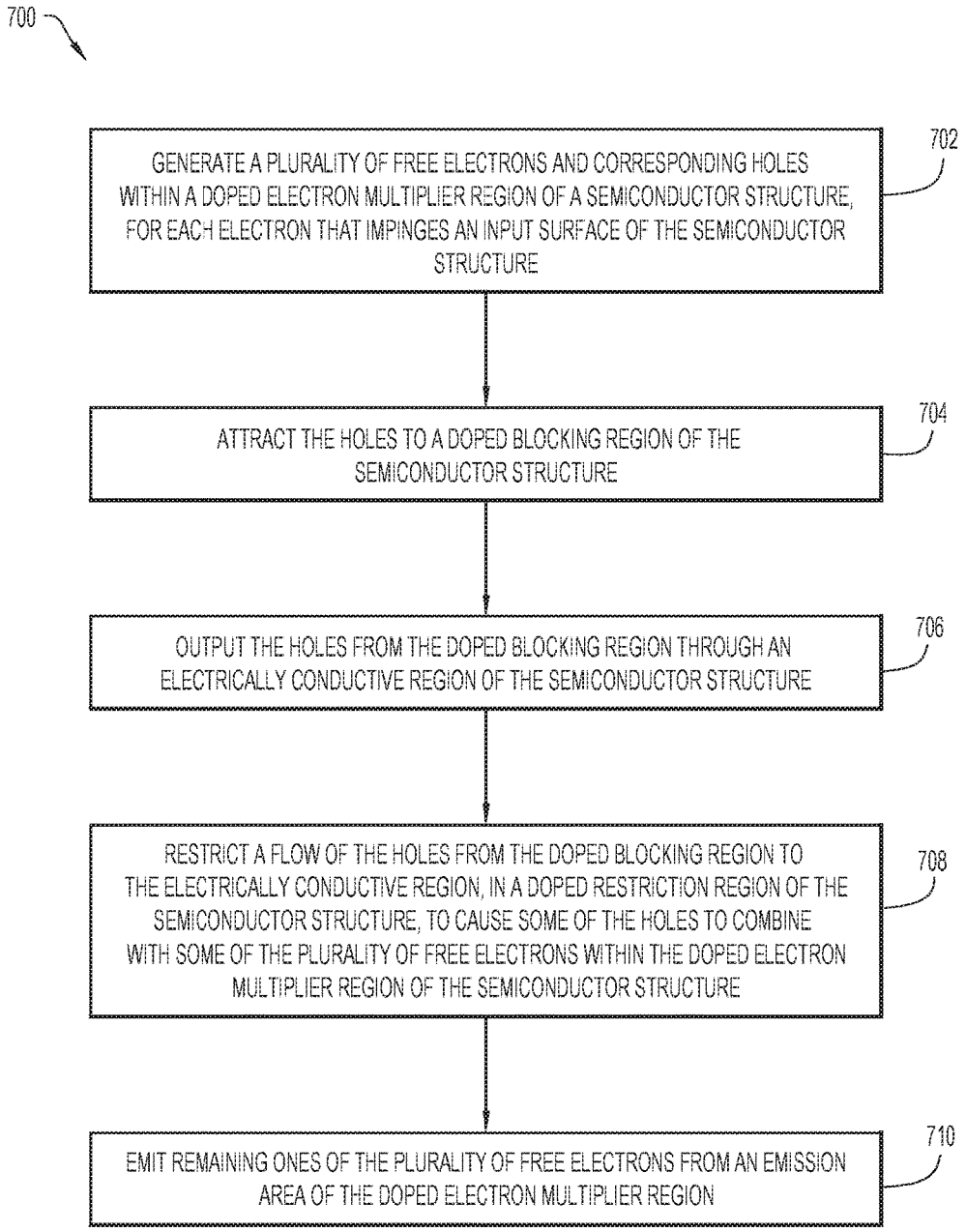
FIG. 7 is a flowchart of a method of intensifying an image and controlling localized high intensity illumination.

FIG. 7 is a flowchart of a method 700 of intensifying an image and limiting effects of stray photons and/or electrons. Method 700 may be performed with an apparatus disclosed herein. Method 700 is not, however, limited to example apparatus disclosed herein.

At 702, a plurality of free electrons and corresponding holes are generated for each electron that impinges an input surface of a semiconductor structure, within a doped electron multiplier region of the semiconductor structure, such as described in one or more examples herein.

At 704, the holes are attracted to a doped blocking region of the semiconductor structure, such as described in one or more examples herein.

At 706, the holes are output from the doped blocking region through an electrically conductive region of the semiconductor structure, such as described in one or more examples herein.

At 708, a flow of the holes from the doped blocking region to the electrically conductive region is restricted within a doped restriction region of the semiconductor structure, to cause some of the holes to combine with some of the plurality of free electrons within the electron multiplier region of the semiconductor structure, such as described in one or more examples herein.

At 710, remaining ones of the plurality of free electrons are emitted from an emission area of the doped electron multiplier region, such as described in one or more examples herein.

Techniques disclosed herein may be implemented with/as passive devices (i.e., with little or no active circuitry or additional electrical connections).

Techniques disclosed herein are compatible with conventional high temperature semiconductor processes and wafer scale processing, including conventional CMOS and wafer bonding processes.

While a particular embodiment of the present invention has been shown and described in detail, adaptations and modifications will be apparent to one skilled in the art. Such adaptations and modifications of the invention may be made without departing from the scope thereof, as set forth in the following claims.

Methods and systems are disclosed herein with the aid of functional building blocks illustrating functions, features, and relationships thereof. At least some of the boundaries of these functional building blocks have been arbitrarily defined herein for the convenience of the description. Alternate boundaries may be defined so long as the specified functions and relationships thereof are appropriately performed. While various embodiments are disclosed herein, it should be understood that they are presented as examples. The scope of the claims should not be limited by any of the example embodiments disclosed herein.

Methods and systems are disclosed herein with the aid of functional building blocks illustrating functions, features, and relationships thereof. At least some of the boundaries of these functional building blocks have been arbitrarily defined herein for the convenience of the description. Alternate boundaries may be defined so long as the specified functions and relationships thereof are appropriately performed. While various embodiments are disclosed herein, it should be understood that they are presented as examples. The scope of the claims should not be limited by any of the example embodiments disclosed herein.

What is claimed is:

1. An apparatus, comprising:

a semiconductor structure that includes, an electron multiplier region that is doped to generate a plurality of electrons and corresponding holes for each electron that impinges a reception surface of the semi-conductor structure;

a blocking region that is doped to attract the holes;

an electrically conductive region to output the holes from the blocking region; and a restriction region that is doped to restrict a flow of the holes from the blocking region to the electrically conductive region such that some of the holes will combine with some of the plurality of electrons within the electron multiplier region;

wherein the electron multiplier region includes an emission area from which to emit remaining ones of the plurality of electrons.

2. The apparatus of claim 1, wherein:

the blocking region and the electron multiplier region are doped with a P-type dopant;

the blocking region is more heavily doped than the electron multiplier region; and the restriction region is doped with an N-type dopant.

3. The apparatus of claim 1, wherein:

the blocking region extends from the emission surface of the semiconductor structure towards the reception surface of the semiconductor structure; and the restriction region is within the blocking region.

4. The apparatus of claim 1, wherein:

the blocking region includes a plurality of blocking regions, each doped to repel the plurality of electrons towards respective adjacent emissions areas of the emission surface of the semiconductor structure;

the electrically conductive region includes a plurality of electrically conductive regions to output holes from respective ones of the blocking regions; and the restriction region includes a plurality of restriction regions, each doped to restrict the flow of the holes from respective ones of the blocking region to respective ones of the electrically conductive regions.

5. The apparatus of claim 4, wherein:

the plurality of blocking regions include multiple rows of blocking channels that extend from the emission surface of the semiconductor structure toward the reception surface of the semiconductor structure;

the plurality of restriction regions include multiple restriction channels, each positioned within a respective one of the blocking channels; and the plurality of electrically conductive regions are disposed over respective ones of the restriction channels.

6. The apparatus of claim 5, wherein:

the multiple rows of blocking channels includes a first and second rows of blocking channels; and the first row of blocking channels is perpendicular to the second row of blocking channels.

7. The apparatus of claim 1, wherein the semiconductor substrate is configured as an array of similarly-configured cells, and wherein an emission surface of a first one of the cells includes:

the electrically conductive region disposed over the restriction region;

the blocking region disposed within the electrically conductive region; and the emission area within the blocking region.

8. The apparatus of claim 1, further including:

a photo-cathode to convert protons to electrons and to direct the electrons toward the reception surface of the semiconductor structure; and an anode to receive the plurality of electrons from the semiconductor structure.

9. A method, comprising:

generating a plurality of free electrons and corresponding holes for each electron that impinges an input surface of a semiconductor structure, within a doped electron multiplier region of the semiconductor structure;

attracting the holes to a doped blocking region of the semiconductor structure;

outputting the holes from the doped blocking region through an electrically conductive region of the semiconductor structure;

restricting a flow of the holes from the doped blocking region to the electrically conductive region, in a doped restriction region of the semiconductor structure, to cause some of the holes to combine with some of the plurality of free electrons within the electron multiplier region of the semiconductor structure; and emitting remaining ones of the plurality of free electrons from an emission area of the doped electron multiplier region.

10. The method of claim 9, wherein:

the blocking region and the electron multiplier region are doped with a P-type dopant;

the blocking region is more heavily doped than the electron multiplier region; and the restriction region is doped with an N-type dopant.

11. The method of claim 9, wherein:

the blocking region extends from the emission surface of the semiconductor structure towards the reception surface of the semiconductor structure; and the restriction region is within the blocking region.

12. The method of claim 9, wherein:

the blocking region includes a plurality of blocking regions, each doped to repel the plurality of electrons towards respective adjacent emissions areas of the emission surface of the semiconductor structure;

the electrically conductive region includes a plurality of electrically conductive regions to output holes from respective ones of the blocking regions; and the restriction region includes a plurality of restriction regions, each doped to restrict the flow of the holes from respective ones of the blocking region to respective ones of the electrically conductive regions.

13. The method of claim 12, wherein:

the plurality of blocking regions include multiple rows of blocking channels that extend from the emission surface of the semiconductor structure toward the reception surface of the semiconductor structure;

the plurality of restriction regions include multiple restriction channels, each positioned within a respective one of the blocking channels; and the plurality of electrically conductive regions are disposed over respective ones of the restriction channels.

14. The method of claim 13, wherein:

the multiple rows of blocking channels includes a first and second rows of blocking channels; and the first row of blocking channels is perpendicular to the second row of blocking channels.

15. The method of claim 9, wherein the semiconductor substrate is configured as an array of similarly-configured cells, and wherein an emission surface of a first one of the cells includes:

the electrically conductive region disposed over the restriction region;

the blocking region disposed within the electrically conductive region; and the emission area within the blocking region.

16. The method of claim 9, further including:

converting protons to electrons with a photo-cathode;

directing the electrons from the photo-cathode toward the reception surface of the semiconductor structure; and receiving the plurality of electrons from the semiconductor structure at an anode.

* * * * *